US010087601B2

(12) United States Patent
Breken

(10) Patent No.: US 10,087,601 B2
(45) Date of Patent: Oct. 2, 2018

(54) CUTTER HEAD

(71) Applicant: IHC Holland IE B.V., Sliedrecht (NL)

(72) Inventor: Roelof Breken, Gorinchem (NL)

(73) Assignee: IHC Holland IE B.V., Sliedrecht (NL)

( * ) Notice: Subject to any disclaimer, the term of this patent is extended or adjusted under 35 U.S.C. 154(b) by 0 days.

(21) Appl. No.: 15/106,377

(22) PCT Filed: Dec. 18, 2014

(86) PCT No.: PCT/NL2014/050876

§ 371 (c)(1),
(2) Date: Jun. 20, 2016

(87) PCT Pub. No.: WO2015/093951

PCT Pub. Date: Jun. 25, 2015

(65) Prior Publication Data

US 2016/0376765 A1 Dec. 29, 2016

(30) Foreign Application Priority Data

Dec. 19, 2013 (NL) ..... 2011994

(51) Int. Cl.
*E02F 3/92* (2006.01)
*E02F 3/88* (2006.01)

(52) U.S. Cl.
CPC ..... *E02F 3/9275* (2013.01); *E02F 3/885* (2013.01); *E02F 3/9231* (2013.01)

(58) Field of Classification Search
CPC ..... E02F 3/9231; E02F 3/9275
See application file for complete search history.

(56) References Cited

U.S. PATENT DOCUMENTS 365,140 A 6/1887 Lynch
682,024 A * 9/1901 Bradley ..... E02F 3/9231 37/325
727,691 A * 5/1903 Robinson ..... E02F 3/9231 37/327
1,226,386 A * 5/1917 Sackett ..... E02F 3/9225 144/219
1,821,177 A * 9/1931 Ellis ..... E02F 3/9231 37/318
2,002,749 A 5/1935 Neveling, Sr.
2,103,124 A * 12/1937 Stires ..... E02F 3/9225 37/328
3,760,518 A * 9/1973 Hamm ..... E02F 3/9231 37/189

(Continued)

FOREIGN PATENT DOCUMENTS

SU 612031 A1 6/1978

OTHER PUBLICATIONS

International Preliminary Report on Patentability and Written Opinion of the International Searching Authority, Int. App. No. PCT/NL2014/050876, dated Jun. 21, 2016.

*Primary Examiner* — Matthew D Troutman
(74) *Attorney, Agent, or Firm* — NLO N.V.; Catherine A. Shultz; Lindsey A. Auerbach

(57) ABSTRACT

A method of forming a cutter head with an axis of rotation comprises forming a hub; forming at least one ring with integral cutter body arm segments extending from the at least one ring; and connecting the hub to the cutter body arm segments so that the hub and the at least one ring are connected and around the axis of rotation.

17 Claims, 6 Drawing Sheets

(56) References Cited

U.S. PATENT DOCUMENTS

| | | | | |
|---|---|---|---|---|
| 9,453,324 | B2 * | 9/2016 | Van Opstal | E02F 3/9231 |
| 2015/0275473 | A1 * | 10/2015 | Van Opstal | E02F 3/9231 37/343 |

* cited by examiner

CUTTER HEAD

BACKGROUND

Cutter-suction dredgers ("CSD") are vessels which can be used to cut and loosen material which is at least partly underwater. This cut material can then be sucked into a suction tube. CSD's are often used to cut hard surface materials, such as rock, although they may also be used to excavate gravel or sand.

CSD's typically use a suction tube with a cutter head at the suction inlet. The cutter head may be connected to the dredger with a hub that is mounted on an axis with a drive to rotate the cutter head. The axis of rotation is referred to as the axial direction of the cutter head. The cutter head and suction inlet may be moveable with respect to the water bed being dredged. In order to draw the material into the suction tube, a wear-resistant pump may be provided, for example, a centrifugal pump. The material cut by the cutter head that has been drawn into the suction tube may then be transported away from the CSD, for example, by a floating pipe line to a dumping location.

A typical cutter head includes a base ring around the suction opening and a hub. The hub and base ring are connected by a plurality of arms extending in an axial direction. The arms may be curved in a tangential and radial direction such that the arms spiral toward each other. In other cutter heads, the arms may be curved in the radial direction only, while being axially aligned or at a small angle with respect to the axial direction. Each arm must be connected to the base ring and to the hub, typically by welding.

The cutter head may additionally be provided with different excavating tools, for example, teeth in the shape of chisels or another shape to assist in the excavation. The teeth can be attached to the arms.

WO2011003869 discloses an example of a cutter head for dredging ground under water. This cutter head is suitable for attachment rotatably around a central axis to a cutter suction dredger and can be moved through the ground therewith in a lateral sweeping movement. The cutter head is formed from support arms which extend spirally between a base ring and a hub located at a distance from the base ring. The support arms are connected to the base ring and to the hub.

SUMMARY

The present invention is directed toward a method of forming a cutter head with an axis of rotation with at least one ring with integral cutter body segments extending from the at least one ring. The method can comprise forming a hub; and connecting the hub to the cutter body arm segments so that the hub and the at least one ring are connected around the axis of rotation.

This method can result in a cutter head which is easier to form due to the location of the connections between cutter body arm segments and the hub.

According to an embodiment, the step of forming at least one ring with integral cutter body arm segments comprises forming a base ring with integral cutter body arm segments.

According to an embodiment, the step of forming a hub comprises forming a hub with hub arm segments. Optionally, the hub arm segments could be formed integral with the hub. Optionally, the embodiment could include connecting the hub arm segments to the hub and/or the cutter body arm segments.

According to an embodiment, the step of forming at least one ring with integral cutter body arm segments comprises forming a supplemental ring with integral cutter body arm segments. Optionally, the step of connecting the hub to the cutter body arm segments comprises connecting the hub to the cutter body arm segments extending from the supplemental ring; and connecting the supplemental ring to the base ring such that the supplemental ring is connected between the base ring and the hub. Optionally, at least a portion of the cutter body arm segments extending from the supplemental ring connect to both the hub and to the base ring. Optionally, these can connect through arm segments connected to and/or formed integrally to the hub and/or the base ring.

According to an embodiment, the hub, hub arm segments and/or at least one ring with cutter body arm segments are connected by welding. Due to the location of the connections being easily accessible, the welding is easier and can result in the use of less materials than past systems.

According to an embodiment, the hub, hub arm segments, cutter body arm segments and/or the at least one ring are connected to loose arm segments.

According to an embodiment, a cutter head with an axis of rotation comprises at least one ring; a hub positioned rotationally symmetric and axially displaced from the at least one ring; and a plurality of arms extending between the at least one ring and the hub. Each arm comprises a first arm segment extending from and formed integral with the at least one ring. Optionally, each arm can further comprise a second arm segment extending from the hub, wherein the first arm segment is connected to the second arm segment to connect the at least one ring to the hub. Optionally, the second arm segment can be formed integral to the hub. Optionally, each of the plurality of arms further comprises third arm segments.

According to an embodiment, the at least one ring comprises a base ring and/or a supplemental ring.

According to an embodiment, third arm segments extend from and are formed integral with a supplemental ring, and the supplemental ring connects to the first arm segments and/or the second arm segments through the third arm segments. Optionally, the third arm segments extend circumferentially inward from the supplemental and/or the third arm segments extend circumferentially outward from the supplemental ring.

According to an embodiment, the first arm segments, the second arm segments and/or the third arm segments are connected by welding and each of the plurality of arms comprises at least one weld zone.

According to an embodiment, the second arm segments and the hub are formed integrally.

According to an embodiment, the first arm segments, the second arm segments and/or the third arm segments, the hub and/or the at least one ring are connected to loose arm segments.

According to a further aspect, there is provided a vessel comprising a cutter head according to any one of the preceding embodiments.

According to an embodiment, a supplemental ring for a cutter head with a hub, a base ring and an axis of rotation comprises a ring portion with integral cutter body arm segments; and connection surfaces on each of the cutter body arm segments for connecting to arm segments, the hub and/or the base ring. When the cutter body arm segments are connected to the arm segments, the hub and/or the base ring; the hub, the supplemental ring and the base ring are positioned around the axis of rotation with the supplemental ring positioned between the base ring and the hub.

According to an embodiment, the cutter body arm segments extend circumferentially inward from the supplemental ring to connect to arm segments and/or to the hub and/or the cutter body arm segments extend circumferentially outward from the supplemental ring to connect to arm segments and/or to the base ring.

According to an embodiment, a base ring for a cutter head with a hub and an axis of rotation comprises a base ring with integrally formed cutter body arm segments; and connection surfaces on each of the cutter body arm segments for connecting to additional arm segments, a supplemental ring, and/or the hub. When the cutter body arm segments are connected to additional arm segments, a supplemental ring, and/or the hub, the base ring connects to the hub and is positioned axially rearward from the hub around the axis of rotation.

By forming at least one ring for the cutter with integral arm segments, the cutter is easier to form due to the connection points being more accessible. When welding is used for connection, less materials are required due to the forming of at least one ring with integral arm segments.

DETAILED DESCRIPTION

Figure 1:
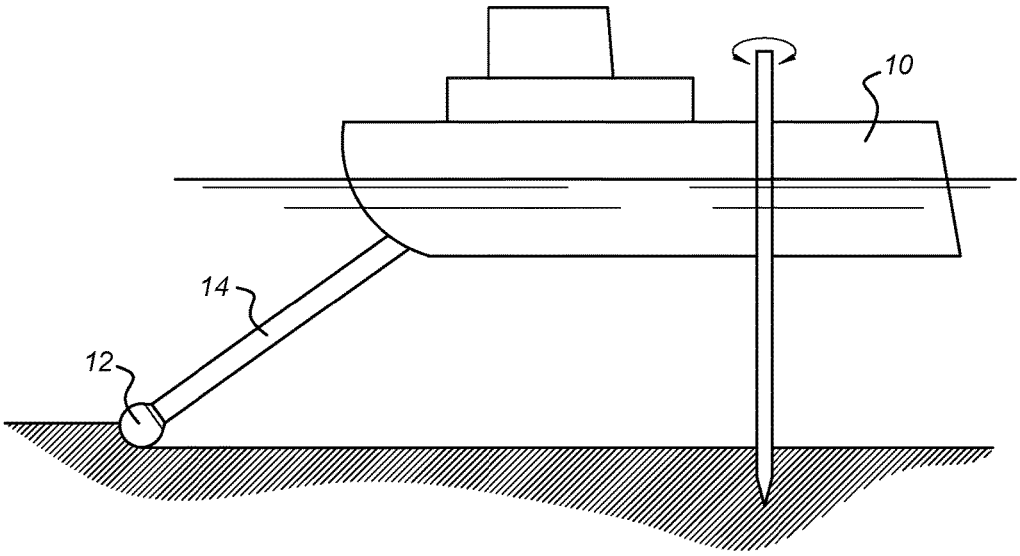
FIG. 1 schematically illustrates an example vessel with a cutter head.

FIG. 1 schematically illustrates an example vessel 10 with a cutter head 12 with axis of rotation RA, and suction tube 14. Vessel 10 can be, for example, a cutter-suction dredger.

As described in the background, cutter head 12 is connected to suction tube 14, and is used to cut hard surface materials, such as rock. Cutter head 12 has a hub 16 (see FIG. 2) which can be connected to and driven by a drive shaft (not shown) to rotate cutter head 12 around axis of rotation RA. The cut material is then drawn into suction tube 14 and transported away from the cutter head 12.

Figure 2A:
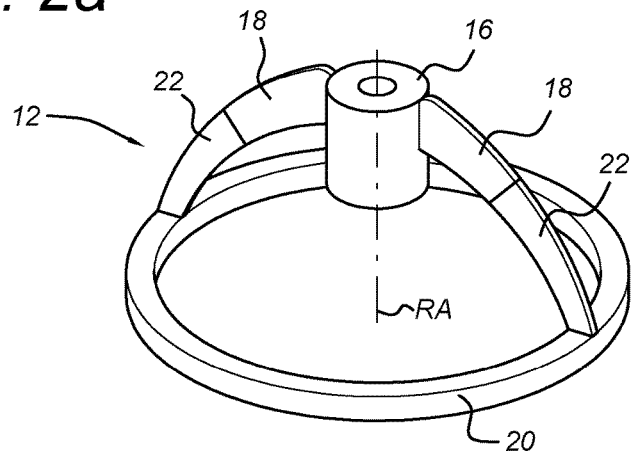
FIG. 2A shows a schematic perspective view of a first embodiment of a cutter head.
Figure 2B:
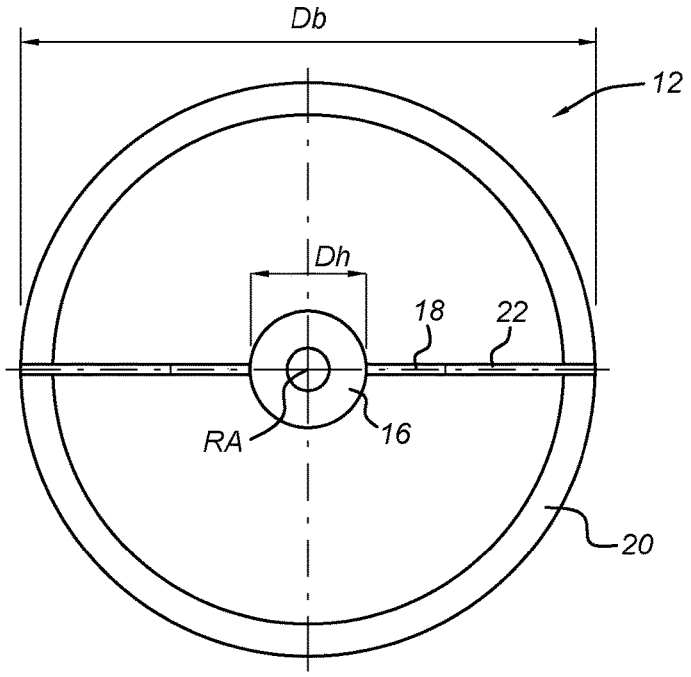
FIG. 2B shows a top view of the cutter head of FIG. 2A.
Figure 2C:
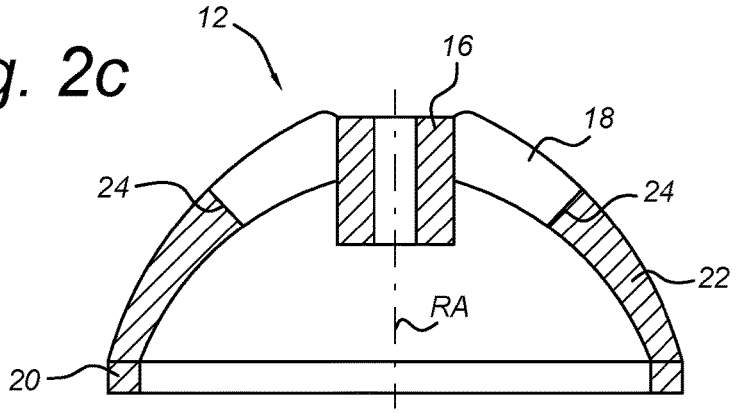
FIG. 2C shows a cross-sectional view of FIG. 2A.
Figure 2D:
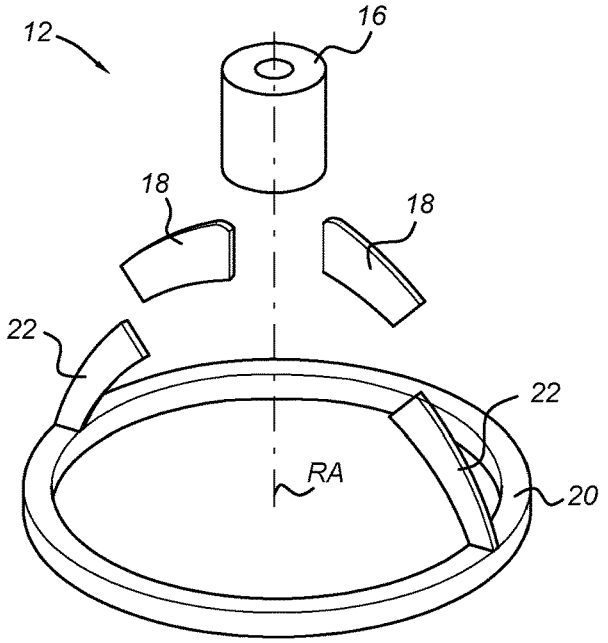
FIG. 2D shows an exploded view of the cutter head of FIG. 2A.

FIG. 2A shows a schematic perspective view of a first embodiment of a cutter head 12, FIG. 2B shows a top view of cutter head 12, FIG. 2C shows a cross-sectional view of cutter head 12, and FIG. 2D shows an exploded view of cutter head 12. Cutter head 12 includes hub 16 with hub diameter $D_H$, hub arm segments 18, base ring 20 with base ring diameter $D_B$, cutter body arm segments 22, weld zones 24 and axis of rotation RA. In FIGS. 2A-2D, cutter head 12 is shown with only two cutter body arm segments 22 and two hub arm segments 18 for viewing purposes only. Typical cutter heads 12 would include a plurality of additional arm segments joining hub 16 with base ring 20.

Cutter body arm segments 22 are formed integral to base ring 20, and can be formed through casting or other means. Hub arm segments 18 can be formed separately from hub as loose arm segments and then can be connected to hub 16. In other embodiments, hub arm segments 18 may be formed integrally with hub 16. Hub 16 has a hub diameter $D_H$ which is typically smaller then base ring diameter $D_B$. Arm segments 22 and 18 typically converge towards the axis of rotation RA in a direction from base ring 20 to hub 16.

In the embodiment shown, hub arm segments 18 extend radially and axially outward from hub 16 and are shorter in length than cutter body arm segments 22. Hub arm segments 18 generally extend symmetrically around the axis of rotation RA when connected to hub 16. Cutter body arm segments 22 extend axially and radially inward from base ring 20. In some embodiments, hub arm segments 18 and/or cutter body arm segments 22 may only extend in the axial or radial direction and/or have different shapes, directions and lengths.

Hub arm segments 18 connect to cutter body arm segments 22 to join hub 16 with base ring 20 at weld zone 24, thereby forming cutter head 12. When hub arm segments 18 connect to cutter body arm segments 22, hub 16 is axially symmetric around the axis of rotation RA and axially displaced in a forward direction from base ring 20.

In the embodiment shown, hub arm segments 18 and cutter body arm segments 22 are joined by welding at weld zone 24. In other embodiments, hub arm segments 18 and cutter body arm segments 22 can be joined by adhesives or other coupling means.

By forming cutter head 12 with hub 16, hub arm segments 18 and base ring 20 with integral cutter body arm segments 18, weld zones 24 of cutter head 12 are easy to reach, making cutter head 12 easier to form than past cutter heads. Typically, past cutter heads were formed by initially forming a hub, a base ring and a plurality of arms to connect the hub to the base ring around the axis of rotation. The arms were individually welded to both the hub and the base ring. This construction required many full or semi-full penetration welds, which was very labour intensive and resulted in having to use a lot of material for the welds. Additionally, the location of the welds made them difficult to perform. By forming base ring 20 and/or hub 16 with integral arm segments 18, 22, weld zones 24 to join arm segments 18, 22 are at a more accessible location, resulting in an easier and less labour-intensive weld. The welds to form cutter head 12 also use fewer materials due to the placement and the forming of cutter body arms 22 integrally with base ring 20.

Figure 3A:
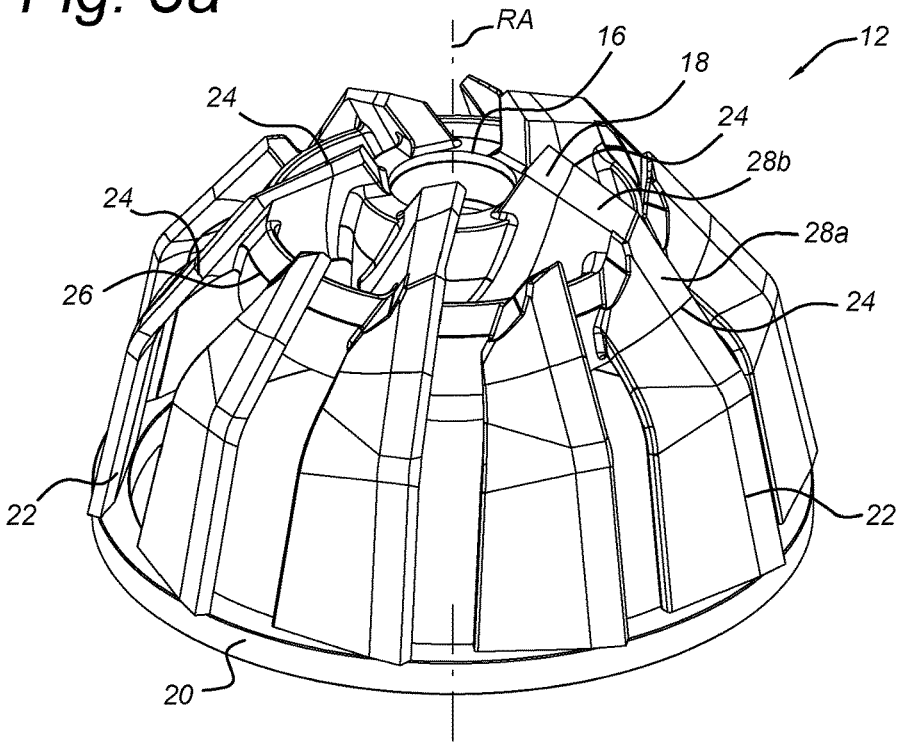
FIG. 3A shows a perspective view of a second embodiment of a cutter head.
Figure 3B:
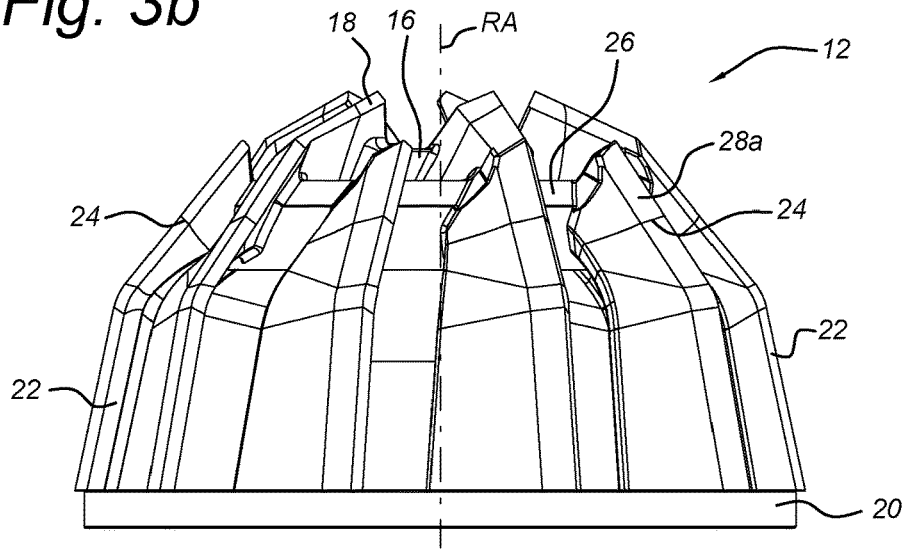
FIG. 3B shows a side view of the cutter head of FIG. 3A.
Figure 3C:
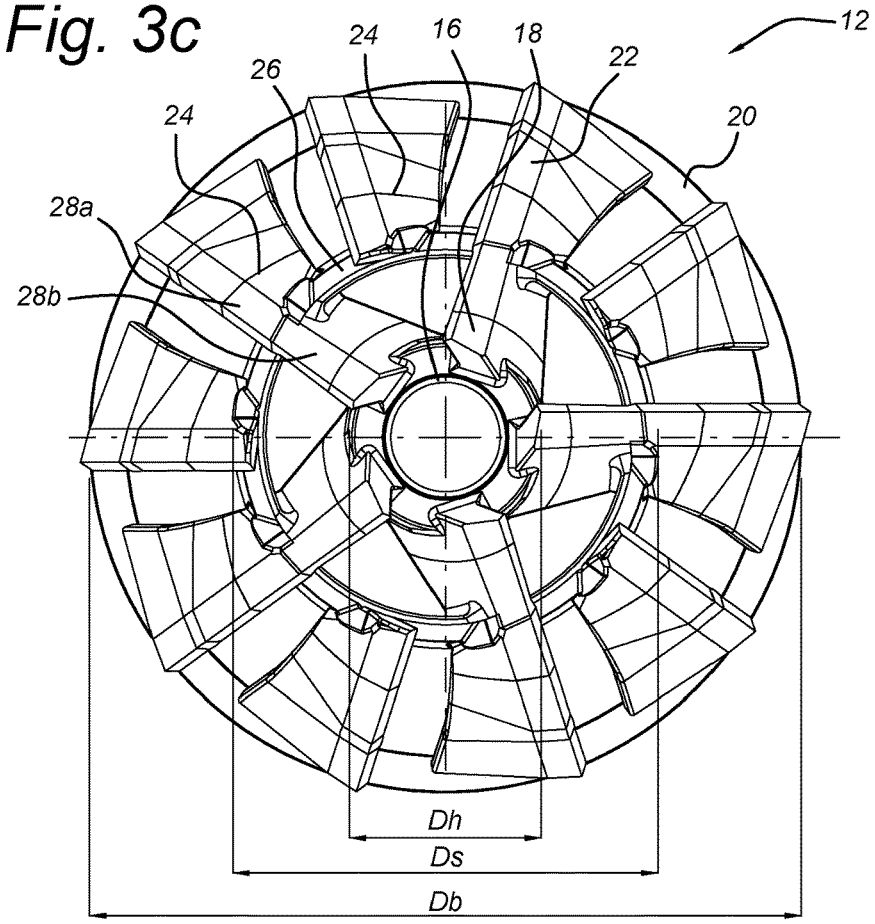
FIG. 3C shows a top view of the cutter head of FIG. 3A.
Figure 3D:
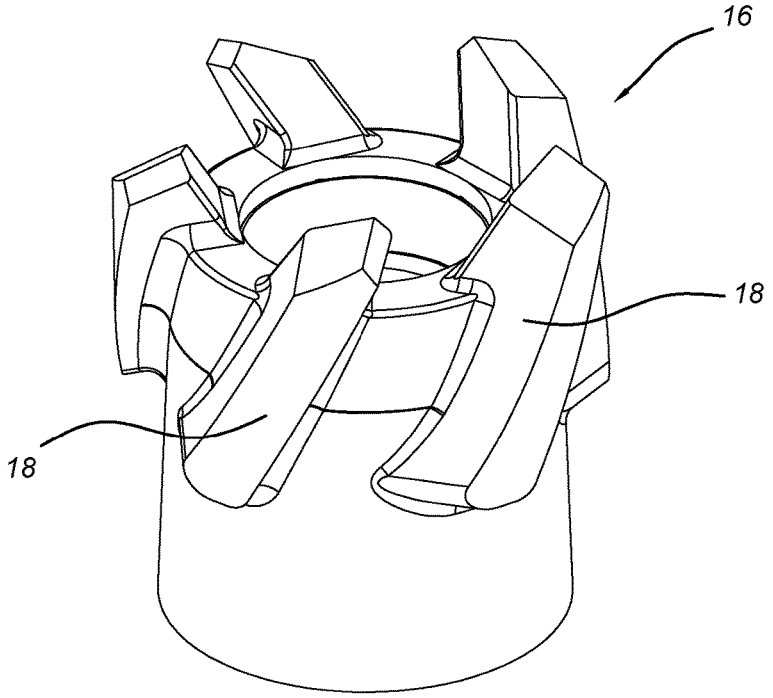
FIG. 3D shows a perspective view of a hub with hub arms from the cutter head of FIGS. 3A-3C.
Figure 3E:
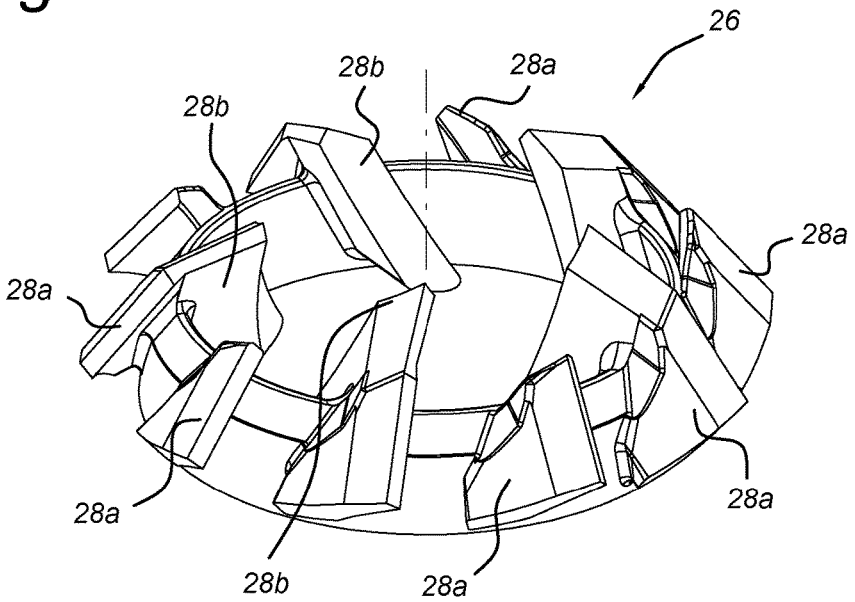
FIG. 3E shows a perspective view of a supplemental ring from the cutter head of FIGS. 3A-3C.
Figure 3F:
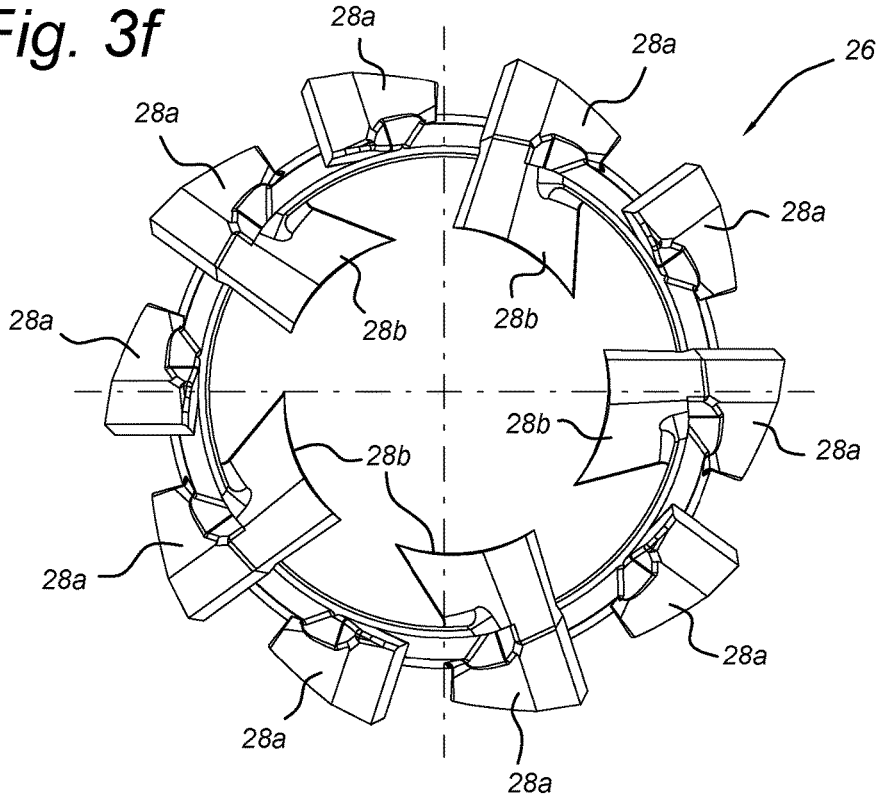
FIG. 3F shows a top view of the supplemental ring of FIG. 3E.
Figure 3G:
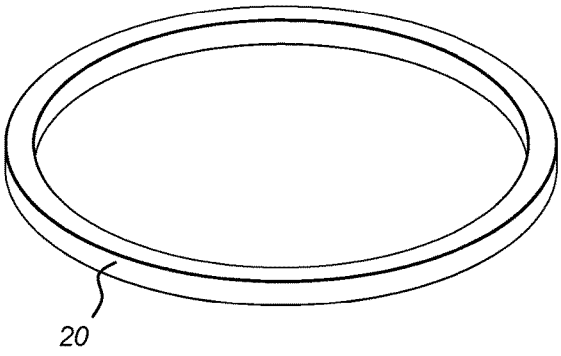
FIG. 3G shows a perspective view of a base ring from the cutter head of FIGS. 3A-3C.
Figure 3H:
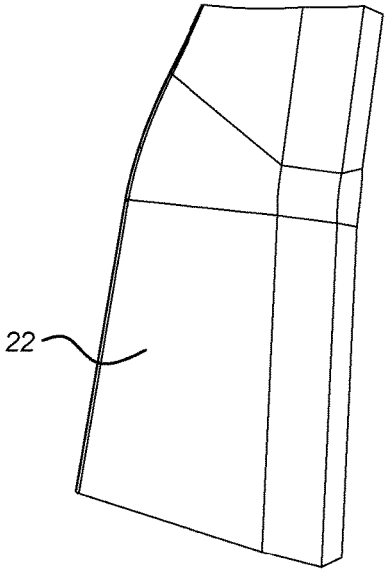
FIG. 3H shows a perspective view of a cutter body arm from the cutter head of FIGS. 3A-3C.

FIG. 3A shows a perspective view of a second embodiment of cutter head 12, FIG. 3B shows a side view of cutter head 12, and FIG. 3C shows a top view of the cutter head 12. FIGS. 3D-3H show the individual components of cutter head 12, including a perspective view of hub 16 (FIG. 3D), a perspective view of supplemental ring 26 (FIG. 3E), a top view of supplemental ring 26 (FIG. 3F), a perspective view of a base ring 20 (FIG. 3G), and a perspective view of a cutter body arm 18 (FIG. 3H). Similar parts use the same numbers as in FIGS. 2A-2C.

Cutter head 12 of FIGS. 3A-3C includes hub 16 with hub diameter $D_H$, hub arm segments 18, base ring 20 with base ring diameter $D_B$, cutter body arm segments 22, weld zones 24, axis of rotation RA and supplemental ring 26 with supplemental ring arms 28*a*, 28*b* and supplemental ring diameter $D_S$.

Hub 16 includes integrally formed hub arms 18. In the embodiment of FIGS. 3A-3C, cutter body arms 22 are not formed integral to base ring 20, and hub 16 and base ring 20 connect through supplemental ring 26 with supplemental arms 28*a*, 28*b*.

Supplemental ring 26 is formed integral with supplemental arms 28*a*, 28*b* extending circumferentially inward (28*b*) and circumferentially outward (28*a*) from supplemental ring 26. Supplemental ring 26 with integral supplemental arms 28*a*, 28*b* can be formed by casting or other means. In the embodiment shown, all supplemental arms 28*a* extend circumferentially outward from supplemental ring 26, and only some supplemental arms 28*b* extend circumferentially inward from supplemental ring 26.

Cutter body arms 22 connect on one end to base ring 20 and on the other end to supplemental body arms 28*a*. Supplemental body arms 28*b* then connect to hub arms 18, thereby connecting base ring 20 to hub 16. Base ring 20, supplemental ring 26 and hub 16 are axially symmetric around the axis of rotation, with supplemental ring 26 positioned axially forward from base ring 20 and hub 16 positioned axially forward from supplemental ring 26. All connections can be formed, for example, by welding at weld zones 24.

As with cutter head 12 of FIGS. 2A-2C, cutter head 12 of FIGS. 3A-3H is easier to form due to the weld zones 24 between hub arms 18 and supplemental arms 28*b* as well as between supplemental arms 28*a* and cutter body arms 22. By forming supplemental ring 26 with integral supplemental arms 28*a*, 28*b* and optionally forming hub 16 with integral hub arms 18, weld zones 24 are more accessible. This results in cutter body 12 being easier to form and requiring less welding materials than when welding past cutter heads which required individually welding each arm to the hub, base ring and possibly the supplemental ring.

While supplemental ring 26 is shown to have five circumferentially inward supplemental arms 28*b* and ten circumferentially outward supplemental arms 28*a*, this is for example purposes only. Other example embodiments could include, but are not limited to, supplemental ring 26 having only circumferentially inward supplemental arms 28*b*, supplemental ring 26 having only circumferentially outward arms 28*a*, supplemental ring having only arms which extend both circumferentially inward and outward, and differing numbers, positioning and/or ratios of circumferentially outward arms 28*a* to circumferentially inward arms 28*b*. Additionally, the number, direction and/or placement of arms 18, 22, 28*a*, 28*b* are shown for example purposes and can vary depending on cutter head 12 needs. For example, arms 18, 22 and/or 28*a*, 28*b* can be angled toward the rotational axis RA in a direction from the base ring to the hub providing a ball-shaped cutter head for cutting capabilities in the radial and axial direction.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims.

The invention claimed is:

1. A method of forming a cutter head with an axis of rotation, the method comprising:
   forming a hub;
   forming additional arm segments;
   forming at least one ring with integral cutter body arm segments extending from the at least one ring and connection surfaces on the end of each arm segment for directly connecting to connection surfaces on the end of each additional arm segment; and
   connecting the hub to the at least one ring by connecting the additional arm segments to the cutter body arm segments so that the hub and the at least one ring are connected around the axis of rotation, and the cutter body arm segments and the additional arm segments form a continuous arm connecting only to the hub and the at least one ring with the connection surfaces at a point between the hub and the at least one ring,
   wherein the connection surfaces of the cutter body arm segments and the additional arm segments form the ends of the arm segments.

2. The method of claim 1, wherein the step of forming at least one ring with integral cutter body arm segments comprises
   forming a base ring with integral cutter body arm segments.

3. The method of claim 1, wherein the step of forming a hub comprises:
   forming a hub with the additional arm segments.

4. The method of claim 3, wherein the additional arm segments are formed integral with the hub.

5. The method of claim 1, wherein the step of forming at least one ring with integral cutter body arm segments comprises: forming a supplemental ring with integral cutter body arm segments; and wherein the step of connecting the hub to the at least one ring comprises:
   connecting the hub to the supplemental ring by connecting the additional arm segments to the cutter body arm segments so that the hub and the supplemental ring are connected around the axis of rotation, and the cutter body arm segments and the additional arm segments form a continuous arm connecting only to the hub and the supplemental ring with the connection surfaces at a point between the hub and the supplemental ring; and
   connecting the supplemental ring to a base ring such that the supplemental ring is connected between the base ring and the hub.

6. The method of claim 5, wherein at least a portion of the cutter body arm segments extending between the hub and the supplemental ring further extend to connect between the supplemental ring and to the base ring.

7. The method of claim 1, wherein the hub or the at least one ring are connected to loose arm segments.

8. A cutter head with an axis of rotation, the cutter head comprising:
   at least one ring;
   a hub positioned rotationally symmetric and axially displaced from the at least one ring; and
   a plurality of arms extending between the at least one ring and the hub;
   wherein each of the plurality of arms comprises first arm segments extending from and formed integral with the at least one ring and connection surfaces forming the ends of the first arm segments for directly connecting to connection surfaces forming the ends of additional arm segments;

wherein the hub and the at least one ring are connected about the axis of rotation by connecting the connection surfaces of the first arm segments to the additional arm segments; and wherein the first arm segments and the additional arm segments form a continuous arm connecting only to the hub and the at least one ring with the connection surfaces at a point between the hub and the at least one ring.

9. The cutter head of claim 8, wherein the additional arm segments comprise:

second arm segments extending from the hub.

10. The cutter head of claim 8, and wherein the at least one ring comprises: a base ring.

11. The cutter head of claim 8, wherein the hub, the at least one ring, and the first arm segments are connected by welding and each of the plurality of arms comprises at least one weld zone at the connection surfaces.

12. The cutter head of claim 9, wherein the additional arm segments and the hub are formed integrally.

13. The cutter head of claim 9, wherein the additional arm segments are shorter than the first arm segments.

14. The cutter head of claim 9, wherein the additional arm segments are loose arm segments.

15. The cutter head of claim 9, and wherein the at least one ring comprises: a supplemental ring.

16. The cutter head of claim 15, and further comprising:

third arm segments extending from and formed integral with the supplemental ring.

17. The cutter head of claim 16, wherein the third arm segments extend circumferentially outward from the supplemental ring toward a base ring.

* * * * *